US005870859A

United States Patent [19]

Kitada

[11] Patent Number: 5,870,859

[45] Date of Patent: Feb. 16, 1999

[54] WATER-TIGHT STRUCTURE FOR SLIDING DOOR

[75] Inventor: Ryuichi Kitada, Kurobe, Japan

[73] Assignee: YKK Architectural Products Inc., Tokyo, Japan

[21] Appl. No.: 928,342

[22] Filed: Sep. 12, 1997

Related U.S. Application Data

[63] Continuation of Ser. No. 598,262, Feb. 7, 1996, abandoned.

[30] Foreign Application Priority Data

Feb. 22, 1995 [JP] Japan ..... 7-033453

[51] Int. Cl.[6] ..... E05D 15/06; E05D 15/16

[52] U.S. Cl. ..... 49/404; 49/406

[58] Field of Search ..... 49/404, 406, 408, 49/425, 458; 52/207, 204.51, 209

[56] References Cited

U.S. PATENT DOCUMENTS

| | | | |
|---|---|---|---|
| 4,237,664 | 12/1980 | Wilmes | 49/471 |
| 4,715,152 | 12/1987 | Tanikawa | 52/209 |
| 4,793,107 | 12/1988 | Pacca | 52/204.51 |
| 4,803,809 | 2/1989 | Takemura | 49/408 |
| 4,958,467 | 9/1990 | Nolan | 52/204.51 |
| 5,123,212 | 6/1992 | Dallaire et al. | 52/209 |
| 5,341,600 | 8/1994 | Heppner | 49/471 |

*Primary Examiner*—Daniel P. Stodola
*Assistant Examiner*—Curtis Cohen
*Attorney, Agent, or Firm*—Finnegan, Henderson, Farabow, Garrett & Dunner, L.L.P.

[57] ABSTRACT

A water-tight structure of a single sliding door capable of ensuring sufficient watertightness without increasing the measurement of a rise provided on a sill so as to apply an entrance. The single sliding door is composed to provide a movable door on a window frame to be able to move in the opening direction of the door and a stationary door and attachments. A pressure-equalized clearance area is formed between the sill of the window frame of the single sliding door and the stationary door and the attachments provided on the sill, and further an air-tight member is provided to divide the pressure-equalized clearance area and an inside clearance area of the single sliding door. By forming the pressure-equalized clearance area between the inside clearance area and the outside clearance area of the single sliding door in the sill portion, a difference in the pressure between the sill portion and the outside is not produced, so that rain water is exhausted by its dead load, with the result that the watertightness can be certain although a rise is formed to a smaller measurement.

6 Claims, 4 Drawing Sheets

WATER-TIGHT STRUCTURE FOR SLIDING DOOR

This application is a continuation, of application Ser. No. 08/598,262 filed Feb. 7, 1996, now abandoned.

BACKGROUND OF THE INVENTION

1. Field of the Invention

This invention relates to a water-tight structure of a single sliding door and, more particularly, to the water-tight structure capable of effectively preventing rain water from entering the bottom end of the single sliding door.

2. Description of the Related Art

A single sliding door is composed of a door frame, a movable door provided to move in the horizontal direction of the door frame, a stationary door fixed in the door frame, and attachments provided next to the stationary door on a lintel and a sill of the frame to cover the frame.

In the single sliding door, a rise is provided for the sill in order that rain water does not enter the inside of the room.

As a matter of fact, if rain water overflows the level of the sill by increasing the pressure difference between the inside and outside of the room by adding wind pressure and so on with rain water thus forming in the sill, an overflow state causing leaking water from rain water or the like in the sill will result.

Therefore, in order to improve watertightness of the sill portion, the rise of the sill portion may be increased so that rain water does not reach an overflow state following the increase of the pressure difference. Conventionally, the required watertightness has been responded to by adjusting the measurement of the rise of the sill.

However, increasing the rise of the sill, a gap between the inside and outside of the single sliding door is increased when the single sliding door is especially used as an entrance, consequently, producing a disadvantage whereby it is difficult to enter.

On the other hand, by decreasing the rise of the sill, watertightness becomes insufficient, consequently, producing a disadvantage in which leaking water results, especially, in strong winds and rainy days, such as a typhoon.

It is an object of the present invention to provide the water-tight structure of the single sliding door capable of being certain that there is sufficient watertightness without increasing the measurement of the rise of the sill and further applied for the entrance.

SUMMARY OF THE INVENTION

The present invention is facilitated to focus attention on a point in which an entrance of rain water receives an effect of the difference of pressure between the inside and the outside of a single sliding door, therefore, rain water can be exhausted by producing the same pressure as the outside pressure to eradicate the difference of the pressure in a sill.

Concretely, the present invention relates to a water-tight structure of the single sliding door, in which a movable door can move in a window frame in an opening direction of the door and a stationary door and attachments are provided therein, to be characterized by having a pressure-equalized clearance area formed between a sill of the window frame and the attachments provided to the stationary door and the sill to link to an outside clearance area of the window frame, and an air-tight member shutting from between the pressure-equalized clearance area and the inside clearance area of the window frame.

Thus in the present invention, a period of a pressure-equalized clearance area is formed between the sill of the window frame, and the stationary door and the lower attachment in the single sliding door, so that the inside clearance area and the outside clearance area are mutually placed across the pressure-equalized clearance area in the bottom side of the single sliding door. As a result, pressure caused by a fleeting great wind pressure to the outside face of the single sliding door transfers to the pressure-equalized clearance area so as to eradicate the difference of the pressure between the outside pressure and the pressure-equalized clearance area, whereby rain water flows down to the outside of the room by its dead load. The presence of the pressure-equalized clearance area causes rain water to be directly exhausted so as not to be sucked in a sash, whereby sufficient watertightness can be obtained although the rise provided on the sill is formed to a small measurement, with the result that rain water is prevented from leaking into the inside of the room.

And, the air-tight member seals between the pressure-equalized clearance area and the inside of the room, result in the prevention of leaking water caused by rain water blowing in.

Therefore, the single sliding door can also be used as an entrance door by ensuring the sufficient watertightness although the measurement of the rise provided in the sill is reduced.

More specifically, the movable door is provided in the outside of the window frame to move in the opening direction of the door, the stationary door is provided to the right half or the left half of the inside of the window frame, the attachments are provided on the other left and right half of the lintel and the sill rather than the right and left half provided thereon with the stationary door, and the air-tight member may be provided on the sill to shut between the pressure-equalized clearance area and the inside clearance area of the window frame by touching the stationary door and the inside of the lower attachment.

Further, the sill of the window frame forms an engaging portion having a flat shape through an initial rise to form a secondary rise on the inside of the engaging portion, the engaging portion engages a quadrilateral tube-shaped lower rail of the stationary door and the lower attachment provided on the sill to be formed in a vertical sectional U-shape having an opening at the bottom, the engaging portion forms a through-hole opened through the vertical direction, the through-hole is further formed on the bottom face of the lower rail of the stationary door, and the pressure-equalized clearance areas are formed in the lower rail of stationary door and in the lower attachment to be linked through the through-holes to the outside clearance area.

According to the aforementioned structure, the pressure-equalized clearance area can be easily formed by forming the through-holes on the engaging portion and the lower rail of the stationary door, resulting in a smaller cost of production.

It is advisable that the air-tight member is provided to a secondary rise provided with the sill to abut to a side face of the lower rail of the stationary door in the inside of the room and to a side face of the lower attachment in the inside of the room, and the air-tight member, the secondary rise, the engaging portion, the stationary door and the lower attachment form a clearance area as a second pressure-equalized clearance area to link to the pressure-equalized clearance area formed in the stationary door and the lower attachment through through-holes opened on a side face of the lower rail in the inside of the room and a side face of the lower attachment in the inside of the room.

As described above, providing plural pressure-equalized clearance areas by additionally forming a second pressure-equalized clearance area linking to the aforementioned pressure-equalized clearance area (a first pressure-equalized clearance area), the difference of the pressure between the pressure-equalized clearance areas can not be produced as seen between the outside clearance area and the pressure-equalized area, whereby the second pressure-equalized clearance area prevents rain water from being sucked in the sash although rain water enters the inside of the first pressure-equalized clearance area, resulting in further improved watertightness.

The air-tight member may be continuously provided from the secondary rise of the sill to a vertical frame of the window frame on a side provided with the stationary door and the lintel of the window frame to abut to the stationary door, the lower attachment and the upper attachment.

The aforementioned continuously provided air-tight member can improve both a sealing performance caused by the air-tight member and an assembled workability for the air-tight member.

Further the single sliding door may be structured so that the movable door is provided in the inside of the window frame to move in the opening direction of the door, the stationary door is provided to the right half or the left half of the outside of the window frame, the attachments are provided on the other left and right half of the lintel and the sill than the right and left half provided thereon with the stationary door, and the air-tight member is provided on the sill to shut between the pressure-equalized clearance area and the inside clearance area of the window frame by touching the stationary door and the inside of the lower attachment.

DETAILED DESCRIPTION OF THE PREFERRED EMBODIMENT(S)

The following will explain a preferable embodiment according to the present invention with reference to the attached drawings.

Figure 1:
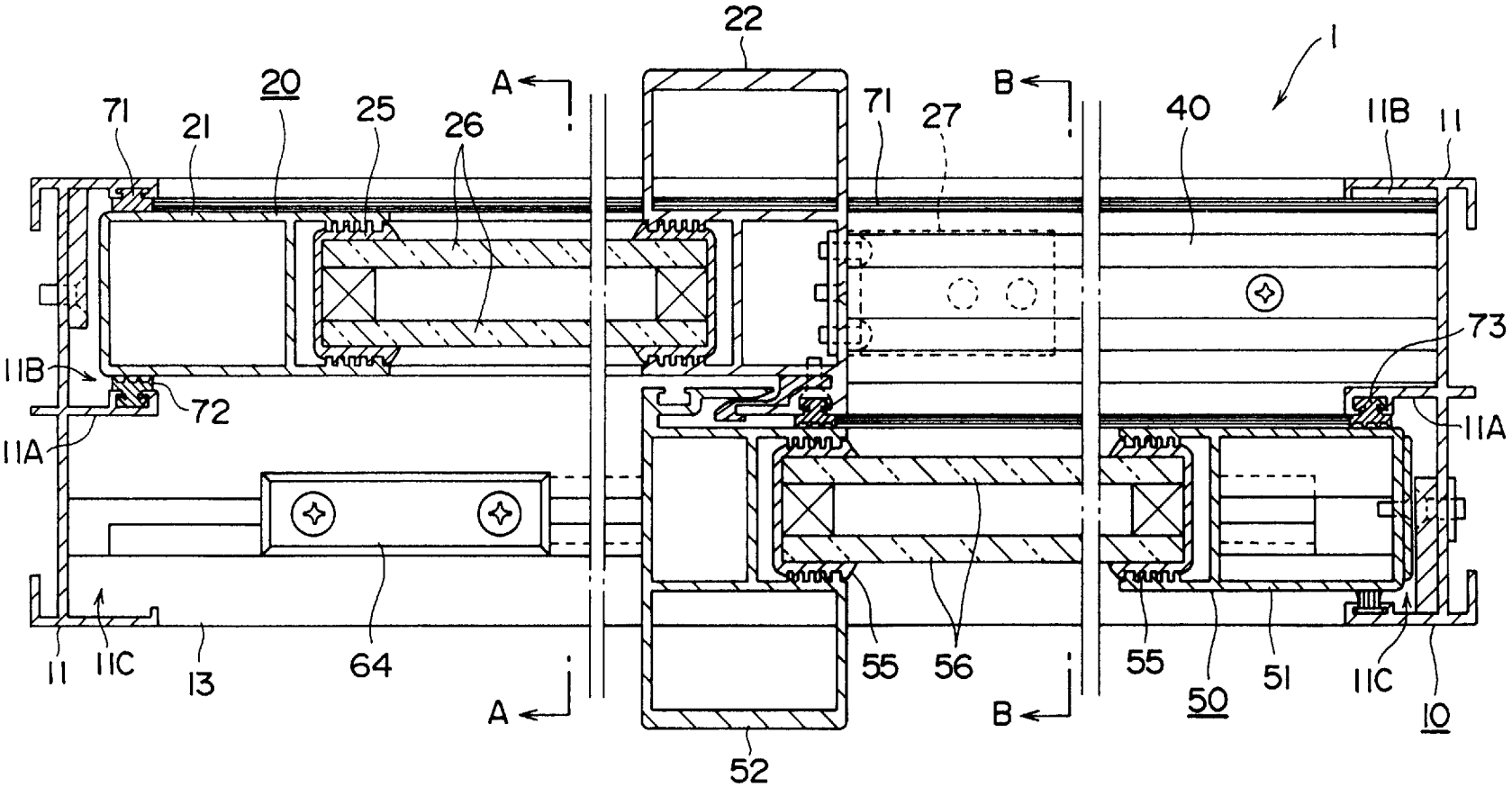
FIG. 1 is a horizontal sectional view of a single sliding door applied in a preferable embodiment according to the present invention.
Figure 2:
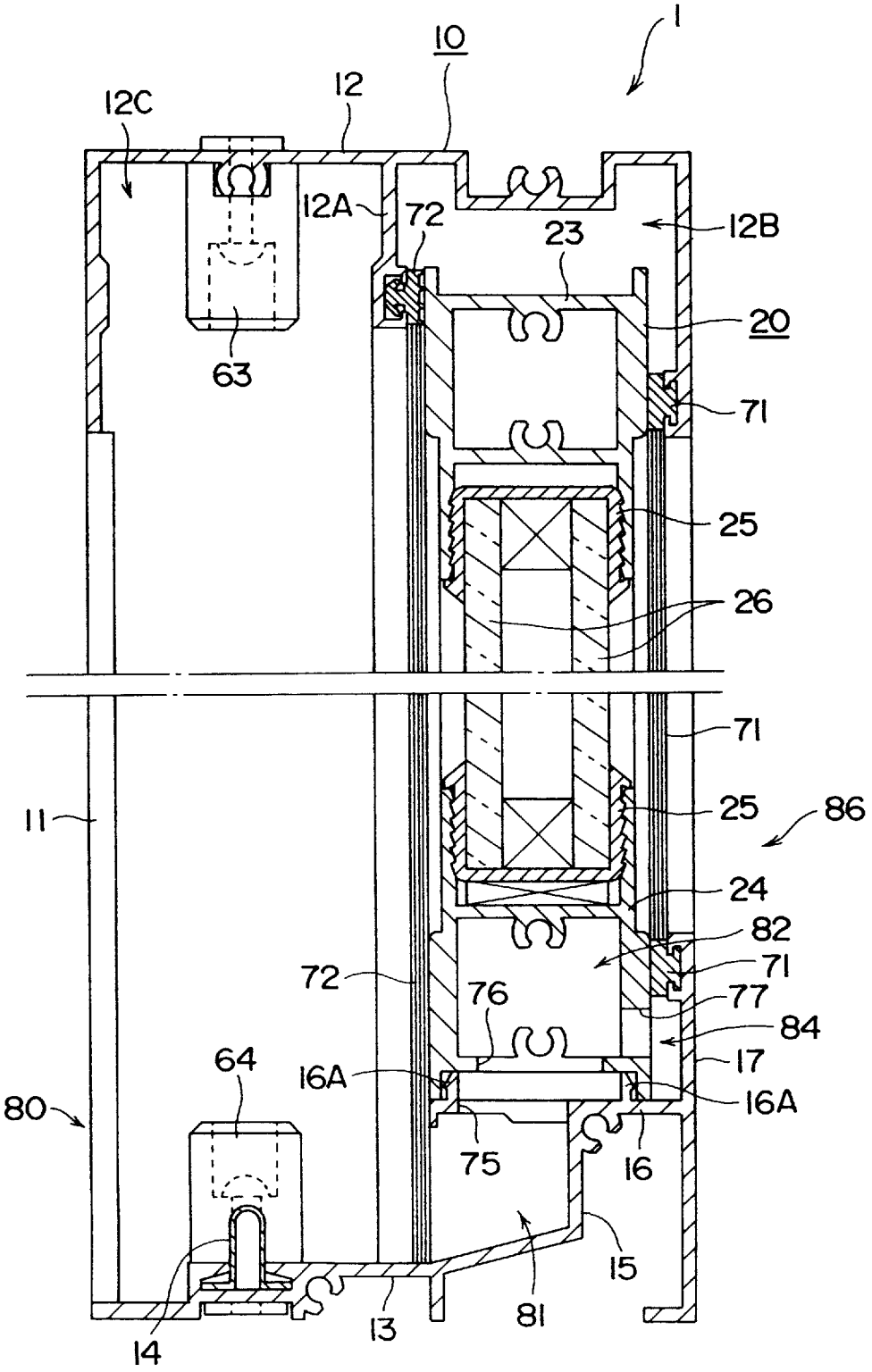
FIG. 2 is a vertical sectional view taken along the line A—A in FIG. 1.
Figure 3:
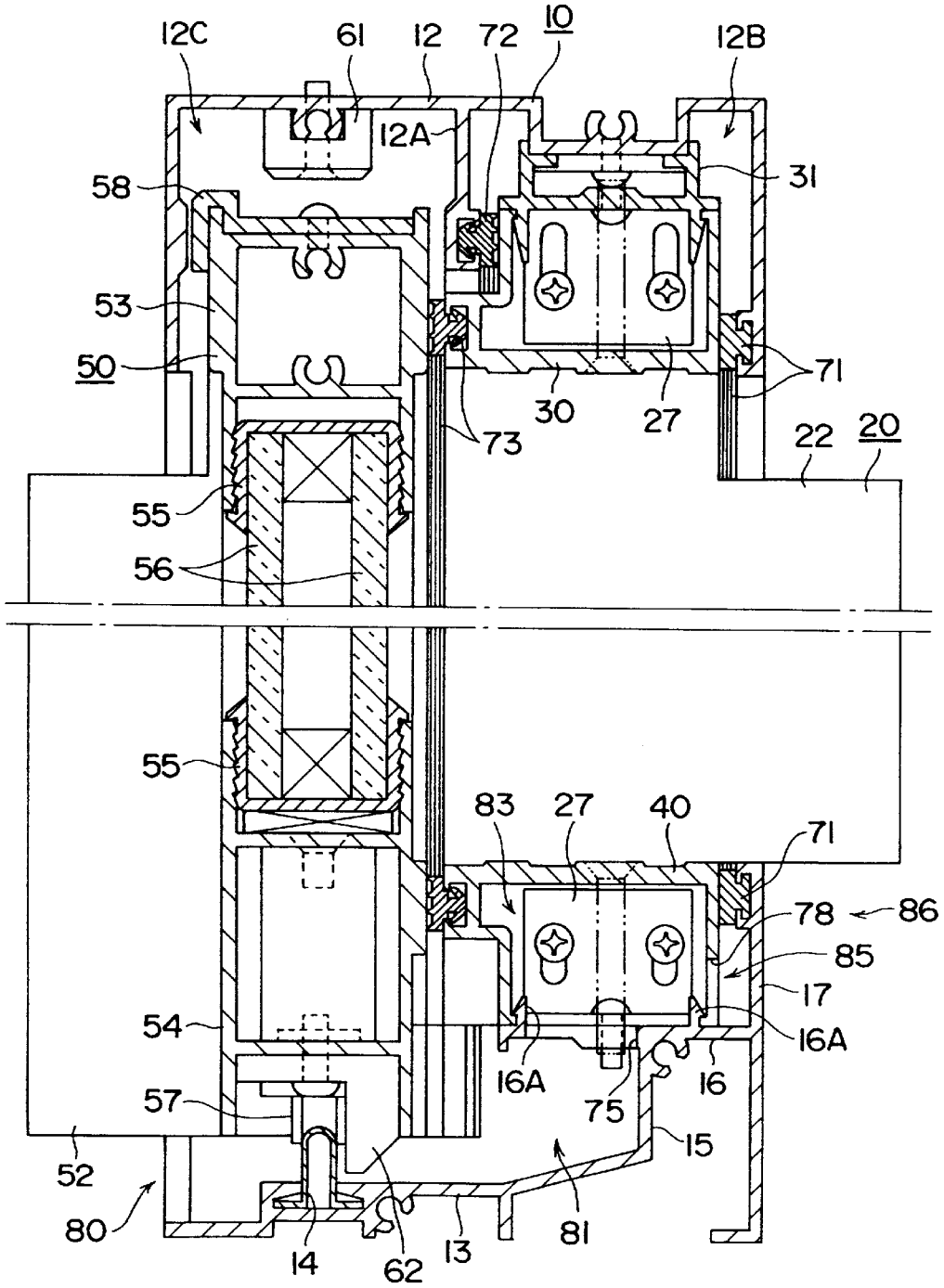
FIG. 3 is a vertical sectional view taken along the line B—B in FIG. 1.

FIG. 1 shows a horizontal sectional view of a single sliding door of the embodiment, and FIGS. 2 and 3 show vertical sectional views respectively taken along the line A—A and the line B—B in FIG. 1. The single sliding door is mainly composed of a window frame 10, a stationary door 20, upper and lower attachments 30 and 40, and a movable door 50.

The window frame is formed to be in a quadrilateral frame state by connecting vertical frames 11 positioned at both right and left sides, a lintel 12 and a sill 13. Each vertical frame 11 has both its sides made of an aluminum extrusion molding member mutually having the same shape.

As shown in FIGS. 2 and 3, the lintel 12 forms a projecting side 12A at a middle section in the direction from the outside to the inside of the room, in which the projecting side 12A divides an indoor recess 12B and an outdoor recess 12C. Similarly, as shown in FIG. 1, a projecting side 11A is formed on the internal side of the vertical frame, in which the projection side 11A divides an indoor recess 11B and an outdoor recess 11C.

Figure 4:
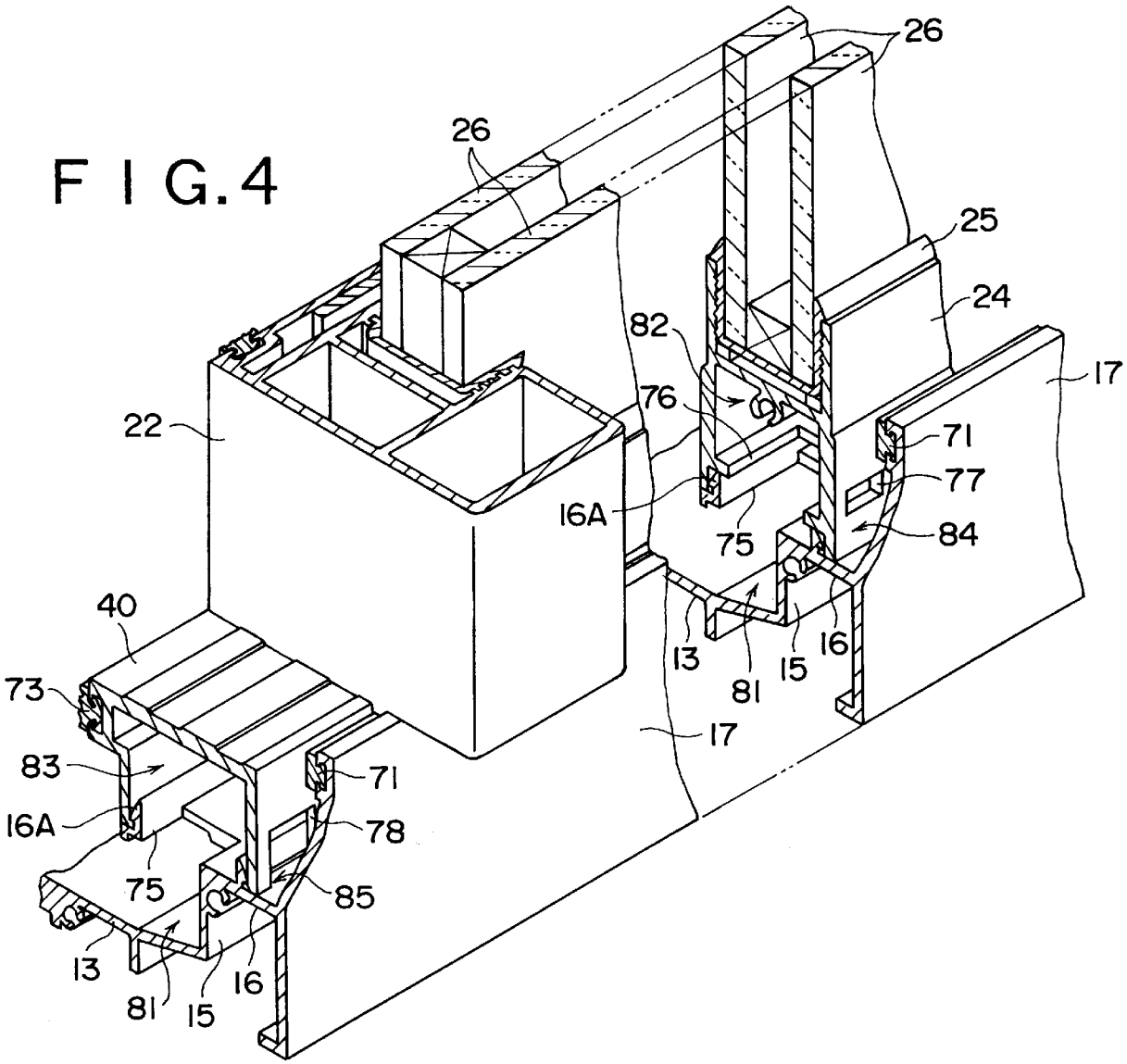
FIG. 4 is a perspective view taken along line the line B—B in FIG. 1.

An approximate sectional U-shaped stainless guide rail with its opening at the bottom 14 guiding the movable door is provided outside of the room on the sill 13. Inside of the room on the sill 13, the sill 13 is formed through an initial rise 15 with an engaging portion 16 of a horizontal plate state and further with a secondary rise 17 as shown in FIG. 4.

A pair of projecting lips 16A are projected on the engaging portion 16 to engage the bottom side of the stationary door 20 or the lower attachment 40.

The stationary door 20 is formed to be in a quadrilateral frame state by connecting a stile 21, a meeting stile 22, an upper rail 23 and a lower rail 24. The upper rail 23 and the lower rail 24 are made of the aluminum extrusion molding member mutually having the same shape. And, double glazing 26 is supported in the internal side among the aforementioned stile 21 to a lower rail 24 through a gasket 25.

The stationary door 20 is provided in the window frame 10 by means of a method which is known as an assembled method. That is, after the stationary door is let by inserting the stile 21 and the upper rail 23 into the indoor recesses 11B and 12B, the stationary door 20 is provided by being let down to engage the lower rail 24 with the projecting lips 16A.

As shown in FIGS. 1 and 3, the meeting stile 22 is fixed through a L-shaped bracket 27 to the lintel 12 and the sill 13 on the external side.

The upper and lower attachments 30 and 40 are adjacent to the stationary door 20, namely, arranged to extend between the meeting stile 22 and the vertical frame 11, on the lintel 12 and the sill 13 respectively.

Concretely, the upper attachment 30 is attached to the indoor recess 12B of the lintel 12 by screwing with vises, and further, is screwed to the lintel 12 with vises.

The lower attachment 40 is engaged with the projecting lip 16A of the sill 13, and further, is screwed to the sill 13 with vises.

The movable door 50 is, as the stationary door, formed in a quadrilateral frame state by connecting a stile 51, a meeting stile 52, a upper rail 53 and a lower rail 54. The stile 51 and the meeting stile 52 are respectively made of the aluminum extrusion molding member having the same configuration as the stile 21 and the meeting stile 22 of the stationary door 20, and the upper rail 53 is made of the aluminum extrusion molding member having the same configuration as the upper and lower rails 23 and 24 of the stationary door 53.

The movable door 50 is also provided with double glazing 56 through a gasket 55 in the internal side from the stile 51 to the lower rail 54.

The lower rail 54 of the movable door 50 is provided with a sash sheave 57 moving on the rail 14 to be capable of moving in the opening direction of the movable door 50. An auxiliary slide 58 is screwed on the upper rail 53 not to contact the upper rail 53 with the lintel 12 when the movable door 50 is moved, whereby the movable door 50 is structured to be capable of moving smoothly.

The movable door 50 is fitted to the window frame 10 by means of the traditionally assembled method as the stationary door 20.

In order to prevent the movable door 50 from falling out, an upper retaining member 61 made of resin is screwed with vises in the middle portion of the opening direction, namely, the portion whereby the stationary and the movable doors meet at the meeting stile, in the outside recess 12C under the lintel 12, and a lower retaining member 62 made of an aluminum molding member is screwed with vises at a position (total: 2 positions) a quarter of the transverse measurement from both sides in the opening direction under the lower rail of the movable door 50.

Incidentally, the lower retaining member 62 is initially provided to the movable door 50, but the upper retaining member 61 is provided after the movable door 50 is fitted in the window frame 10.

As shown in FIGS. 1 and 2, door stoppers 63 and 64 are respectively screwed with vises to the lintel 12 and the sill 13 of the window frame 10 to prevent the movable door 50 from bumping against the vertical frame by controlling the opening position of the movable door 50 when the door 50 is opened.

An air-tight member 71 is provided to the vertical frame 11 of the window frame 10 which is the side being provided with the stationary door 20, the lintel 12 of the window frame 10, and the secondary rise 17 provided with the sill 13 of the window frame 10 to abut to the stationary door 20 and the attachments 30 and 40.

Further, an air-tight member 72 is provided to the projecting sides 11A and 12A of the lintel 12 and the vertical frame 11 which is the side being provided with the stationary door 20 to abut to the stile 21 and the upper rail 23 of the stationary door 20 and the upper attachment 30. The air-tight member 71 is provided in an approximate sectional U-shaped state, and the air-tight member 72 is provided in an approximate L-shaped state.

An air-tight member 73 is consecutively provided onto all four sides of the meeting stile 22 of the stationary door 20, the attachments 30 and 40, and the vertical frame 11 of the side providing the attachments 30 and 40 to abut to the movable door 50 when the door 50 is closed.

The air-tight member 73 has four fins continuing around the four sides to cause the fins to abut onto the movable door 50, whereby the movable door 50 is not hindered in its movement and further can maintain its air-tight performance.

As known from FIGS. 2 to 4, plural through-holes 75 are opened on the engaging portion 16 provided with the sill 13 of the window frame 10 along the opening direction of the door. And further, plural through-holes 76 are opened on the lower side of the lower rail 24 of the stationary door 20. Plural through-holes 77 and 78 are opened on the side surfaces of the lower rail 24 and the lower attachment 40 in the inside of the room.

Therefore, a clearance area 80, which is formed on the outside of the room of the single sliding door 1, is linked through the through-holes 75 and 76 and a clearance area 81 formed on the outside of the room of the single sliding door by the initial rise 15 provided with the sill 13 to a first pressure-equalized clearance area 82 formed in the lower rail 24 of the stationary door 20 and a first pressure-equalized clearance area 83 formed in the lower attachment 40. The first pressure-equalized clearance areas 82 and 83 which are located on mutually opposite sides of meeting stile 22 of stationary door 20 are linked through the through-holes 77 and 78 to second pressure-equalized clearance areas 84 and 85 respectively formed between the secondary rise 17 provided to the sill 13 and the lower rail 24, and the secondary rise 17 and the lower attachment 40.

Incidentally, that the air-tight member 71 maintains an air-tight seal between the pressure-equalized areas 84 and 85 and a clearance area 86 of the single sliding door 1 in the inside of the room.

In the embodiment, when air pressure in the clearance area 80 is increased by adding wind pressure to the single sliding door 1 in the outside of the room, naturally, air pressure in the clearance area 81 linking with the clearance area 80 is increased.

On the other hand, in the pressure-equalized clearance areas 82 and 83 linked through the through-holes 75 and 76 with the clearance area 81, pressure is transferred by providing the through-holes 75 and 76 as a linking path, so that pressure in the pressure-equalized clearance areas 82 and 83 promptly result in the same pressure as the outside. As a result, rain water entering the pressure-equalized clearance areas 82 and 83 is naturally exhausted to the outside of the room by its dead load regardless of the difference between the pressures.

According to the embodiment, in the single sliding door 1, rain water never reaches the air-tight member 71 which maintains the water-tight performance of an area of the sill 13, so that, in many cases, rain water is exhausted from the pressure-equalized clearance area to the outside, whereby it can be structured that rain water is completely prevented from entering and further the stable high watertightness can be maintained although the measurement of the secondary rise 17 is reduced.

The pressure-equalized clearance areas 82 to 85 can be easily formed by opening the through-holes 75 to 78 on the engaging portion 16, the lower rail 24 and the attachment 40, whereby the cost of production can be kept low.

As compared with the conventional art, the measurement of the rise in the sill 13 can be defined as minimal so as to allow for a small gap between the inside and the outside of the single sliding door, therefore, the single sliding door can be used as an entrance.

The difference of the pressure between the pressure-equalized clearance areas 82 to 85 cannot be produced as in the case between the clearance areas 80 and 81 and the pressure-equalized clearance areas 82 and 83 by forming plural pressure-equalized clearance areas 82 to 85 so that the second pressure-equalized clearance areas 84 and 85 are formed to link to the first pressure-equalized clearance areas 82 and 83, whereby the watertightness can be further improved.

The stationary door 20 and the circumference of the movable door 50 of the single sliding door 1 are completely air-tightened by providing the air-tight member 71 to 73, resulting in a complete prevention of leaking water into the inside of the room regardless of the flow of the rain water.

The movable door 50 is structured to be lightly touched on its surface with the four fins of the air-tight member 73, thereby there is no hindrance for the movement of the movable door 50, resulting in an excellent air-tight performance.

The upper retaining member 61 is provided to the lintel 12 of the window frame 10 and the lower retaining member 62 is provided to the lower rail 54 of the movable door 50, with the result that the movable door 50 is certainly prevented from lifting and falling out although the movable door 50 is added with negative pressure caused by the wind blowing. For example, the movable door 50 never falls out or comes away from the window frame even when the strength of the wind pressure reaches 120 psp (−587 kgf/m$^2$), therefore, the effectiveness caused by producing the upper and lower retaining members 61 and 62 is ascertained.

The stiles 21 and 51, the meeting stiles 22 and 52, the upper and lower rails 23, 24 and 53 and so on composing the stationary door 20 and the movable door 50 are respectively structured with members having the same configuration so as to be able to use each member in common, resulting in a smaller cost of production.

It is to be understood that the present invention is not intended to be limited to the aforementioned embodiments, and various changes and modifications of the design may be made therein without departing from the spirit of the present invention. Such changes and modifications are also included in the scope of the present invention.

For example, both first and second pressure-equalized clearance areas 82 to 85 are formed in the aforementioned embodiment, however, only the first pressure-equalized clearance areas 82 and 83 may be formed. In other words, there should be at least one pressure-equalized clearance area formed between the outside clearance area 80 and the inside clearance area 86 of the single sliding door 1, therefore, the number of formed pressure-equalized clearance areas may be defined according to the particular situation.

The method for forming the pressure-equalized clearance area is not intended to be limited to the method using the lower rail 24 or the inside of the attachment 40 which is opened with the through-holes 75 to 78 as being formed in the aforementioned embodiment, and it is possible to use a suitable method in which, for example, a through-hole having a slit-shape is opened.

Further, the single sliding door is not limited to be used with the movable door provided on the outside as the aforementioned embodiment, the present invention can be applied to, for example, a single sliding door providing the movable door on the inside. The concrete structure and configuration of the window frame 10, the stationary door 20, the attachments 30 and 40, the movable door 50, and so on may be defined according to the particular situation that will govern the assembling request.

According to the present invention, the single sliding door can be applied to use as an entrance by obtaining the watertightness without increasing the measurement of the rise provided with the sill.

What is claimed is:

1. A water-tight structure in combination with a sliding door assembly in which a movable door is mounted relative to a stationary door and is movable in a door frame with an inside and an outside, said door frame having a sill and allowing movement of the movable door in a horizontal direction from a closed position to an open position, the door frame having upper and lower attachments mounted opposite the moveable door and the stationary door positioned in the door frame, said water-tight structure comprising:

means, including an initial rise on the sill, for defining a clearance area on the outside of said sliding door;

a first pressure-equalized clearance area formed by the sill of the door frame and a rail of the stationary door mounted on the sill;

a second first pressure-equalized clearance area formed by the sill and the lower attachment mounted on the sill, said first and second first pressure-equalized clearance areas being located over said clearance area and on mutually opposite sides of a meeting stile on said stationary door, said first and second first pressure-equalized clearance areas being connected through holes to said clearance area on the outside of the structure, and said holes located through a bottom surface of said first and second first pressure-equalized clearance areas, and wherein said holes are capable of draining water from said first and second first pressure-equalized clearance areas to clearance area; and an air-tight member positioned to seal said first and second first pressure-equalized clearance areas from the inside of the structure.

2. The water-tight structure as claimed in claim 1:

wherein said movable door is positioned on the outside of the door frame;

wherein said stationary door is positioned on the inside of the door frame;

wherein said attachments are provided on the other half of the lintel and the sill from the half provided with said stationary door; and wherein said air-tight member is positioned on the sill to seal said pressure-equalized clearance area from the inside clearance area of the door frame by light contact with said stationary door and the inside of said lower attachment.

3. The water-tight structure as claimed in claim 1:

wherein the sill of the door frame forms an engaging portion with a horizontal surface between an initial rise of the sill positioned towards the outside of the door frame and a secondary rise of the sill positioned towards the inside of the door frame;

wherein said engaging portion engages a quadrilateral tube-shaped lower rail of said stationary door and said attachment positioned on the sill and formed in a vertical sectional U-shape having an opening at the bottom;

wherein said engaging portion includes a through-hole opened through the vertical direction;

wherein the bottom face of the lower rail of said stationary door includes a through-hole coincidental with the engaging portion through-hole; and wherein said first first and second first pressure-equalized clearance areas are formed in the lower rail of the stationary door and in said attachment such that said pressure-equalized clearance areas are linked through said through-holes to the outside clearance area.

4. The water-tight structure as claimed in claim 3:

wherein said air-tight member is positioned along the secondary rise of the sill to abut a side face of the lower rail of the stationary door facing the inside side of the door frame and to abut a side face of said attachment facing the inside side of the door frame; and wherein said air-tight member, the secondary rise, said engaging portion, said stationary door and said attachment form a second pressure-equalized clearance area linking said first first and second first pressure-equalized clearance areas to each other through through-holes on a side face of the lower rail in the inside side of the door frame and a side face of said lower attachment in the inside side of the door frame.

5. The water-tight structure as claimed in claim 4, wherein said air-tight member is continuously positioned along said secondary rise of the sill to a vertical frame of the door frame on a side provided with said stationary door and the lintel of the door frame to abut to said stationary door, said lower attachment and said upper attachment.

6. The water-tight structure as claimed in claim 1:

wherein said movable door is positioned on the inside of the door frame to move in the opening direction of the door;

wherein said stationary door is positioned on the outside of the door frame;

wherein said attachments are provided on the other half of the lintel and the sill from the half provided with said stationary door; and wherein said air-tight member is positioned on the sill to seal said pressure-equalized clearance area from the inside clearance area of the door frame by contact with said stationary door and the inside of said lower attachment.

* * * * *